US005423660A

United States Patent [19]

Sortor

[11] Patent Number: 5,423,660

[45] Date of Patent: Jun. 13, 1995

[54] FAN INLET WITH CURVED LIP AND CYLINDRICAL MEMBER FORMING LABYRINTH SEAL

[75] Inventor: Michael Sortor, Watertown, Mass.

[73] Assignee: Airflow Research and Manufacturing Corporation, Watertown, Mass.

[21] Appl. No.: 79,317

[22] Filed: Jun. 17, 1993

[51] Int. Cl.[6] ..... F01D 05/22

[52] U.S. Cl. ..... 416/189; 416/247 R

[58] Field of Search ..... 415/173.6, 228; 416/169 A, 189 R, 247 R

[56] References Cited

U.S. PATENT DOCUMENTS

| | | | |
|---|---|---|---|
| 2,030,993 | 2/1936 | Langenkamp et al. | 415/173.6 |
| 2,225,406 | 12/1940 | Anderson . | |
| 2,303,832 | 12/1942 | Funk . | |
| 2,656,974 | 10/1953 | Holstein | 416/247 R |
| 3,433,403 | 3/1969 | Gerlitz . | |
| 3,620,640 | 11/1971 | Soulez-Lavivier . | |
| 3,677,660 | 7/1972 | Taniguchi et al. | 416/189 R |
| 4,213,426 | 7/1980 | Longhouse . | |
| 4,329,946 | 5/1982 | Longhouse . | |
| 4,358,245 | 11/1982 | Gray . | |
| 4,396,351 | 8/1983 | Hayashi et al. . | |
| 4,548,548 | 10/1985 | Gray, III . | |
| 4,566,852 | 1/1986 | Hauser . | |
| 4,569,631 | 2/1986 | Gray, III . | |
| 4,569,632 | 2/1986 | Gray, III . | |
| 4,657,483 | 4/1987 | Bede . | |
| 4,685,513 | 8/1987 | Longhouse | 416/189 R |
| 4,927,328 | 5/1990 | Scoates et al . | |

*Primary Examiner*—Edward K. Look
*Assistant Examiner*—Mark Sgantzos
*Attorney, Agent, or Firm*—Fish & Richardson

[57] ABSTRACT

An improved plastic, injection-molded shroud/banded fan combination in which the shroud extends axially from an inlet portion to an outlet portion, and the outlet portion comprises means for connecting a heat exchanger to the shroud, More specifically, the shroud includes an inlet lip which is curved in cross-section and positioned at the inlet portion of the shroud. The lip extends radially inward and axially downstream from the inlet portion of the shroud to a trailing edge. An intermediate cylindrical wall is attached to said inlet lip. The intermediate cylindrical wall is positioned: 1) coaxially with the fan; and 2) radially between the inner surface of the shroud and portions of the outer surface of the fan band so as to form a wall-to-band radially restrictive running clearance.

18 Claims, 2 Drawing Sheets

FAN INLET WITH CURVED LIP AND CYLINDRICAL MEMBER FORMING LABYRINTH SEAL

BACKGROUND OF THE INVENTION

This invention relates to plastic injection molded fans positioned in a shroud to blow air through a downstream heat exchanger.

Important considerations in the design of a fan shroud include maximum efficiency, minimum noise, and economy of manufacture. Specifically, fan shrouds are designed to: provide smooth flow of air into the entire fan disk area; minimize the flow of air that recirculates from the fan outlet to the inlet through the running clearances between the fan and shroud; and to permit one piece injection molding of parts.

It is common for cooling fans (particularly fans for automotive applications) to be configured in a shroud to blow air through a downstream heat exchanger. It may be advantageous in applications of such fans to use a banded fan, i.e., one in which the blade tips are connected by a rotating ring. Such a construction avoids generating a blade tip vortex such as would be generated by unbanded fan blades, thus reducing noise and increasing efficiency. Such a construction also enhances blade strength, thus permitting added fan blade skew to further reduce noise. See, e.g., Gray U.S. Pat. No. 4,358,245; Gray U.S. Pat. No. 4,548,548; Gray U.S. Pat. No. 4,569,631, each of which is hereby incorporated by reference.

It is desirable in certain applications to support the fan drive system on the upstream side of the fan.

It also may be desirable to cover the fan inlet with a guard to prevent injury from accidental contact with the rotating fan blades, however such constructions can interfere with desirable smooth airflow.

Specific prior art constructions are disclosed in the following documents.

Anderson U.S. Pat. Nos. 2,225,406, Gerlitz 3,433,403; and Bede 4,657,483 disclose shroud inlets for unbanded fans. The shroud surface adjacent to the fan is a smooth continuation of the inlet surface.

Funk U.S. Pat. Nos. 2,303,832 and Scoates 4,927,328 disclose unbanded fans running in shrouds that provide both axial and radial running clearances. The inlet diameter of the shrouds are substantially smaller than that of the fan blades.

Soulez-Lariviere, U.S. Pat. No. 3,620,640 discloses an unbanded fan operating in a shroud having a continuous surface forming the fan inlet and fan outlet.

Hayashi U.S. Pat. No. 4,396,351 discloses a banded fan and shroud combination in which the shroud terminates adjacent the fan in a straight (unflared) section having a diameter greater than the fan blade diameter.

Longhouse U. S. Pat. Nos. 4,213,426 and 4,329,946 disclose banded engine cooling fans in which the inlet flaring is formed as part of the rotating band.

Hauser U.S. Pat. No. 4,566,852 discloses a banded engine cooling fan with a shroud having an inlet diameter substantially smaller than that of the fan blades, and having an inlet lip that encloses the inlet end of the fan band.

SUMMARY OF THE INVENTION

The invention generally concerns plastic injection-molded shroud/banded fan combinations. Combinations according to the invention are characterized in that the fan blades are connected at their outer tips by a band, and a shroud is positioned around the fan. The shroud extends axially from an inlet portion to an outlet portion, and the outlet portion is formed to guide the flow of air from the shroud into a heat exchanger.

Stated generally, the invention features such banded fan/shroud combinations in which the shroud includes an inlet lip which is curved in cross-section and positioned at the inlet portion of the shroud. The lip extends radially inward and axially downstream from the inlet portion of the shroud to a trailing edge. An intermediate cylindrical wall is attached to the inlet lip. The intermediate cylindrical wall is positioned: 1) coaxially with the fan; and 2) radially between the inner surface of the shroud and portions of the outer surface of the fan band so as to form a wall-to-band radially restrictive running clearance.

In preferred embodiments of the fan and shroud combination, the trailing edge of the shroud inlet lip is positioned approximately at the outermost radial extent of the fan blades. Also, the trailing edge of the shroud inlet lip is offset axially from the upstream edge of the fan blades so as to establish a lip-to-blade axially restrictive running clearance therebetween.

Also in preferred embodiments, the band comprises an integral flange, positioned at the outlet end of the band and extending radially outward from the outer tip of the blades. Most preferably, the maximum radius of the flange is at least about 1.04 times the outer radius of the fan blades. The shroud comprises a cylindrically shaped shroud portion adjacent to the fan, which has a radius greater than that of the flange At its radially outermost point, the flange forms a flange-to-shroud radially restrictive running clearance with the inner surface of the shroud.

The shroud inlet lip is preferably configured to have either a circular or an elliptical cross-section.

Also preferably, the intermediate cylindrical wall is positioned with its inner radius not exceeding that of the flange on the fan band, and the intermediate cylindrical wall extends axially rearward from the inlet lip and terminates upstream of (axially adjacent) the flange on the fan band, forming a flange-to-wall axially restrictive running clearance therebetween.

Also in preferred embodiments, the combination comprises a drive means (e.g., a motor) for the fan and a support for the drive means which is attached to the lip. Other preferred features include a protective guard positioned around the fan inlet and a support for the protective guard, the protective guard support being attached to the lip. The fan and shroud combination may also comprise aerodynamically shaped vanes attached to the inlet lip and positioned at an angle to the inlet airflow to impart rotational energy to the fan inlet airstream. Finally, the lip may include openings that connect the space between the cylindrical wall and the outer shroud with airflow outside the shroud, e.g. an opening in the outer shroud wall. Such openings may guide recirculating airflow away from the of an inlet. More specifically, the outer shroud wall may have at least one opening connecting a space radially outward of the intermediate cylindrical wall with space outside the shroud. In this way, recirculating airflow is directed away from the above described lip-to-blade axially restrictive running clearance.

Other features and advantages of the invention will be apparent from the following description of the preferred embodiments thereof and from the claims.

DESCRIPTION OF THE PREFERRED EMBODIMENT(S)

Figure 1:
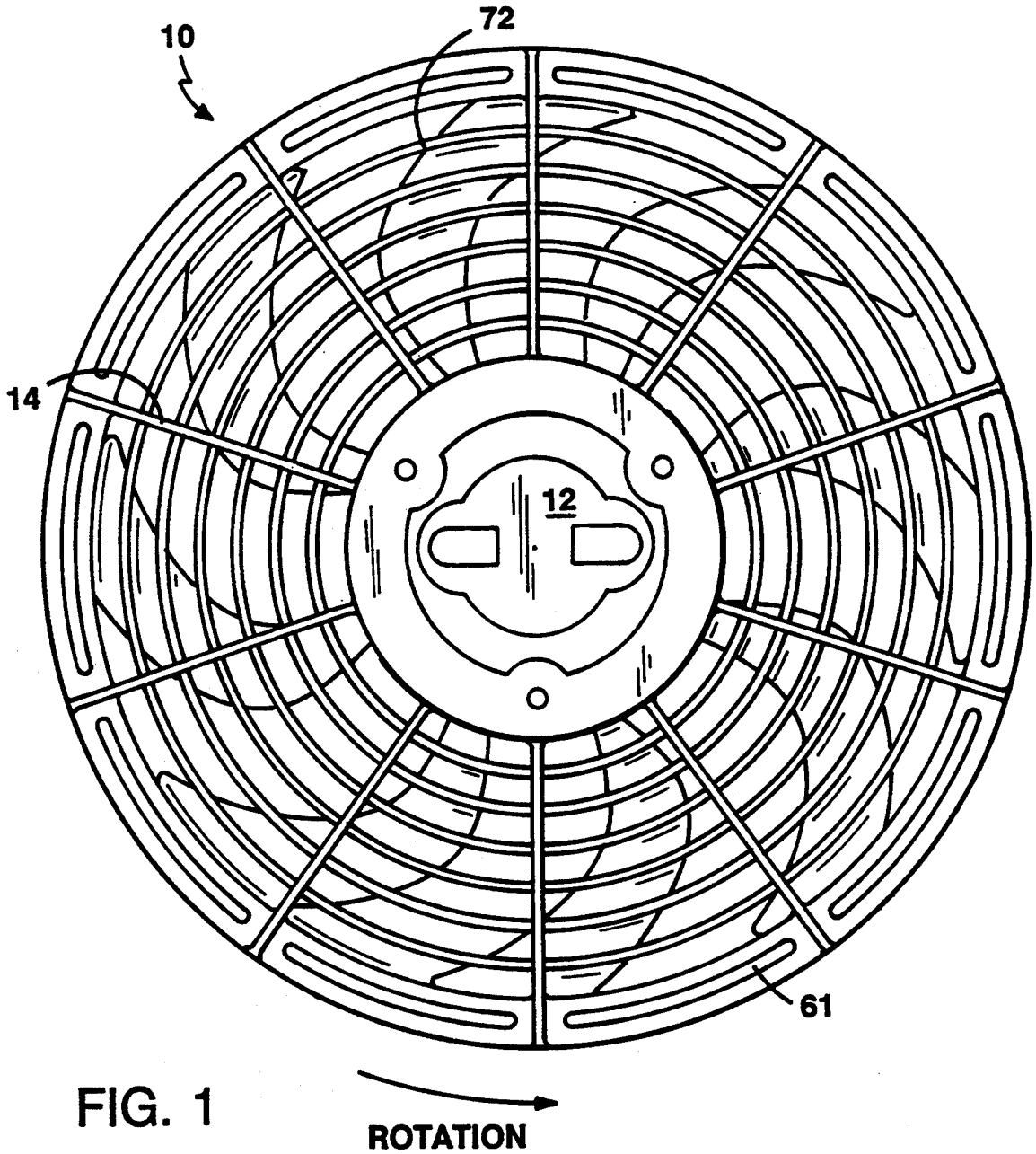
FIG. 1 is a view of a fan and shroud combination according to the invention, taken from the upstream side.

In FIG. 1, assembly 10 is a fan and shroud combination, including an electric motor 12 and a fan inlet guard 72. The fan is a banded, back skewed fan such as described in Gray, U.S. Pat. No. 4,569,632, hereby incorporated by reference. Assembly 10 is mounted to a heat exchanger such as an automobile radiator or condenser so that the fan forces air through the heat exchanger.

Figure 2:
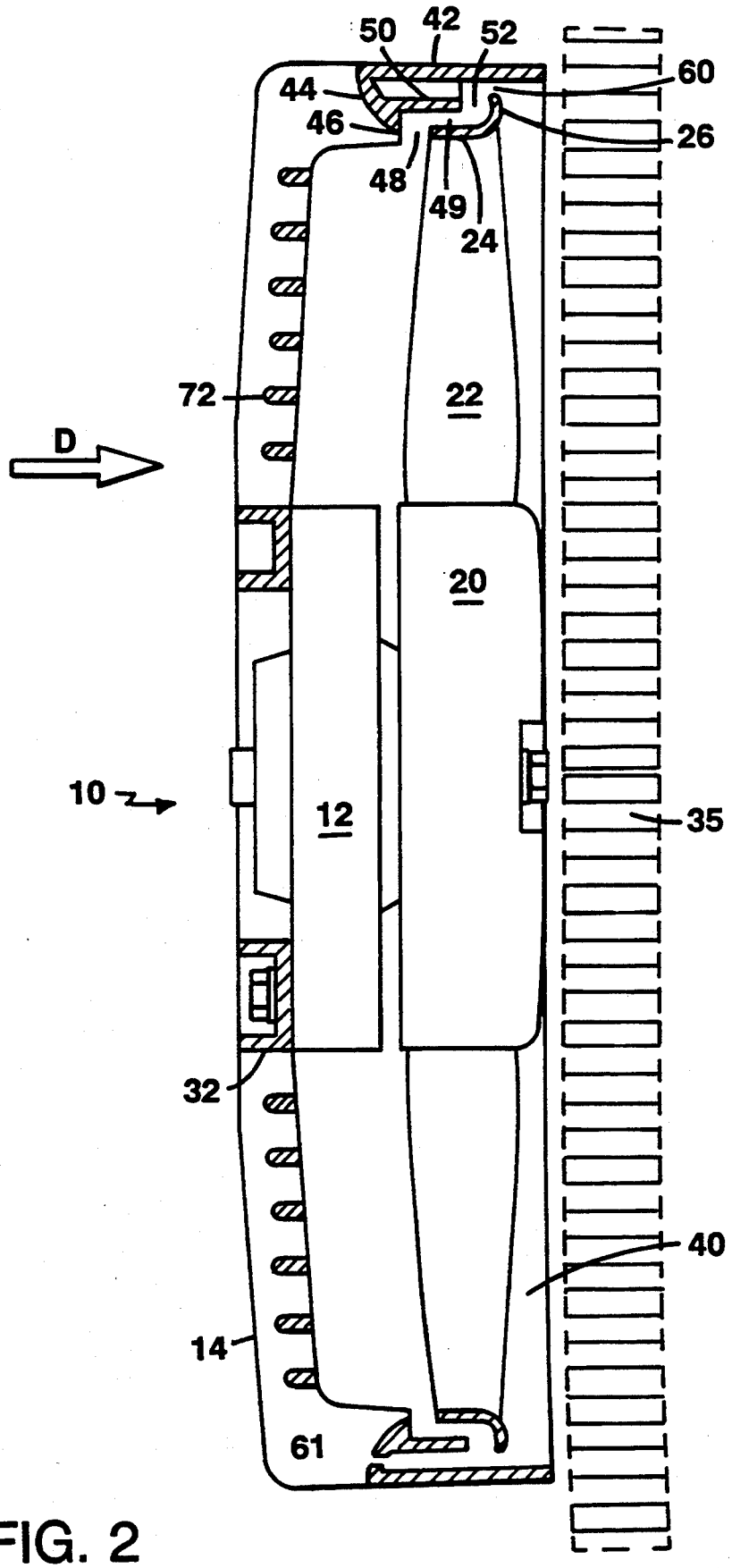
FIG. 2 is a section of the fan and shroud taken of FIG. 1.

FIG. 2 is a section showing fan 20 and shroud 40. Band 24 is cylindrical in shape and connects the outermost ends of the fan blades 22. Band 24 includes an integral flange 26 extending radially outward from the outlet end of the band. Preferably, the outer radius of flange 26 is at least 1.04 times the outer radius of blades 22. Fan 20 rotates in the direction shown in FIG. 1 and blades 22 blow air through heat exchanger 35 in the direction indicated by arrow D in FIG. 2. The fan is driven by motor 12.

Shroud 40 includes a cylindrical section 42 which extends from an inlet portion upstream of fan 20 to an outlet portion downstream of the fan and adjacent to heat exchanger 35.

Shroud 40 includes an integral inlet lip of curved cross section which extends axially downstream and radially inward from the inlet end of cylindrical section 42. The trailing edge 46 of lip 44 is positioned axially a short distance upstream, and radially approximately at the outer radius, of the fan blades 22. The lip trailing edge 46 forms a restrictive running clearance 48 axially with the fan blades 22.

Lip 44 may include openings 61 to guide the recirculating airflow away from the clearance 48. The openings may be positioned as shown in FIG. 2 for an axial flow path, or the openings may be in the outer shroud wall for radially directed flow. Flow through such Openings could then be entrained with flow entering the fan inlet, and is less disruptive to the inlet flow than is flow through restriction 48.

Intermediate wall or ring 50 is integral with shroud 40, positioned coaxially with fan 20 and at a radius not greater than the outer radius of band flange 26, and extends axially downstream from lip 44. A restrictive running clearance 49 is established radially between the general extent of band 24 and intermediate ring 50. Another restrictive running clearance 60 is formed radially between the outer edge of flange 26 and the inside of cylindrical shroud 42. An additional restrictive running clearance 52 is formed axially between the trailing edge of intermediate ring 50 and band flange 26.

Advantageously, motor mount ring 32, which forms the attachment point of motor 12, is attached to the inlet area of lip 44 via radial supports 14, which also support protective guard 72. Supports 14 may be aerodynamically configured to impart rotational energy into the incoming flow, in order to improve fan performance.

Advantageously, each of the above described components is plastic and can be injection molded in a relatively simple manufacturing process that minimizes the numbers of parts in the assembly and the number of assembly steps.

Other embodiments are within the following claims.

What is claimed is:

1. A plastic, injection-molded shroud in combination with a fan, said fan comprising blades connected at their outer tips by a band, said shroud being positioned around said fan, said shroud extending axially from an inlet portion to an outlet portion, said outlet portion being formed to guide airflow into a heat exchanger;

a) said shroud comprising an inlet lip which is curved in cross-section and positioned at the inlet portion of the shroud, said lip extending radially inward and axially downstream from the inlet portion of the shroud to a trailing edge;

b) said fan band comprising an integral flange extending radially outward from the outer tip of said blades, said flange being flared away from the direction of airflow, toward the outlet of said shroud;

c) said shroud further comprising an intermediate cylindrical wall attached to said inlet lip of said shroud, said intermediate cylindrical wall being positioned: 1) radially between the inner surface of said shroud and portions of the outer surface of said fan band so as to form a wall-to-band radially restrictive running clearance; 2) with its inner radius not exceeding that of the flange on the fan band; 3) to extend axially rearward from the inlet lip terminating axially adjacent and upstream of the flange on the fan band, forming a flange-to-wall axially restrictive running clearance therebetween.

2. A plastic, injection-molded shroud in combination with a fan, said fan comprising blades connected at their outer tips by a band, said shroud being positioned around said fan, said shroud extending axially from an inlet portion to an outlet portion, said outlet portion being formed to guide airflow into a heat exchanger;

a) said shroud comprising an inlet lip which is curved in cross-section and positioned at the inlet portion of the shroud, said lip extending radially inward and axially downstream from the inlet portion of the shroud to a trailing edge; said lip comprises openings for guiding recirculating airflow away from said fan inlet;

b) said shroud further comprising an intermediate cylindrical wall attached to said inlet lip, said intermediate cylindrical wall being positioned radially between the inner surface of said shroud and portions of the outer surface of said fan band so as to form a wall-to-band radially restrictive running clearance.

3. A plastic, injection-molded shroud in combination with a fan, said fan comprising blades connected at their outer tips by a band, said shroud being positioned around said fan, said shroud extending axially from an inlet portion to an outlet portion, said outlet portion being formed to guide airflow into a heat exchanger;

a) said shroud comprising an inlet lip which is curved in cross-section and positioned at the inlet portion of the shroud, said lip extending radially inward and axially downstream from the inlet portion of the shroud to a trailing edge;

b) said shroud further comprising an intermediate cylindrical wall attached to said inlet lip, said intermediate cylindrical wall being positioned radially between the inner surface of said shroud and portions of the outer surface of said fan band so as to form a wall-to-band radially restrictive running clearance, said trailing edge of said shroud inlet lip being offset axially from the upstream edge of said fan blades so as to establish a lip-to-blade axially restrictive running clearance therebetween, said inlet portion of said shroud comprising an outer shroud wall having at least one opening connecting a space radially outward of said intermediate cylindrical wall with space outside the shroud, whereby recirculating airflow is directed away from said lip-to-blade axially restrictive running clearance.

4. The shroud and fan combination of claims 1, 2, or 3 in which said trailing edge of said shroud inlet lip is positioned approximately at the outermost radial extent of the fan blades.

5. The shroud and fan combination of claims 1, or 2 in which said trailing edge of said shroud shroud inlet lip is offset axially from the upstream edge of said fan blades so as to establish a lip-to-blade axially restrictive running clearance therebetween.

6. The shroud and fan combination of claims 2 or 3 wherein said band comprises an integral flange extending radially outward from the outer tip of said blades.

7. The shroud an fan combination of claim 6 in which the maximum radius of said flange is at least about 1.04 times the outer radius of the fan blades.

8. The shroud and fan combination of claim 6 further characterized in that said shroud comprises a cylindrically shaped shroud portion adjacent to said fan, said cylindrically shaped shroud portion having a radius greater than that of said flange.

9. The shroud and fan combination of claim 6 wherein said flange at its radially outermost point forms a flange-to-shroud radially restrictive running clearance with the inner surface of said shroud.

10. The shroud and fan combination of claim 6 in which the intermediate cylindrical wall is positioned with its inner radius not exceeding that of the flange on the fan band, said intermediate cylindrical wall extending axially rearward from the inlet lip terminating upstream of the flange on the fan band.

11. The fan and shroud combination of claim 10 wherein said intermediate cylindrical wall terminates axially adjacent the fan band flange, forming a flange-to-wall axially restrictive running clearance therebetween.

12. The fan and shroud combination of claims 1, 2, or 3 further comprising a drive means for said fan and a support for said drive means, said drive means support being attached to said lip.

13. The fan and shroud combination of claims 1, 12, 2 or 3 further comprising a protective guard positioned around the fan inlet and a support for said protective guard, said protective guard support being attached to said lip.

14. The fan and shroud combination of claim 1 wherein said lip comprises openings for guiding recirculating airflow away from said fan inlet.

15. The fan and shroud combination of claim 1 5, or 2 wherein said inlet portion of said shroud comprises an outer shroud wall having at least one opening connecting a space radially outward of said intermediate cylindrical wall with space outside the shroud, whereby recirculating airflow is directed away from said lip-to-blade axially restrictive running clearance.

16. The shroud an fan combination of claim 1 in which the maximum radius of said flange is at least about 1.04 times the outer radius of the fan blades.

17. The shroud and fan combination of claim 1 further characterized in that said shroud comprises a cylindrically shaped shroud portion adjacent to said fan, said cylindrically shaped shroud portion having a radius greater than that of said flange.

18. The shroud and fan combination of claim 1 wherein said flange at its radially outermost point forms a flange-to-shroud radially restrictive running clearance with the inner surface of said shroud.

* * * * *

UNITED STATES PATENT AND TRADEMARK OFFICE

CERTIFICATE OF CORRECTION

PATENT NO. : 5,423,660

DATED : June 13, 1995

INVENTOR(S) : Michael Sortor

It is certified that error appears in the above-identified patent and that said Letters Patent is hereby corrected as shown below:

Cover page, [57] Abstract, line 5, after "shroud", delete "," and insert --.--.

Col. 2, line 33 , after "flange", insert --.--.

Col. 2, line 62, after "the", delete-- of an--.

Col. 3, line 8, after "side", delete "," and insert --.--.

Col. 3, line 49 "Openings" should be --openings--.

Col. 4, line 45, delete ";" and insert --,--.

Col. 5, line 18, after "1", delete --,--.

Col. 5, line 19, delete the second occurrence of "shroud".

Col. 5, line 26, "an" should be --and--.

Col. 6, line 21, after "1", insert --,--.

UNITED STATES PATENT AND TRADEMARK OFFICE

CERTIFICATE OF CORRECTION

PATENT NO. : 5,423,660

DATED : June 13, 1995

INVENTOR(S) : Michael Sortor

It is certified that error appears in the above-indentified patent and that said Letters Patent is hereby corrected as shown below:

Col. 6, line 28, "an" should be --and--.

Signed and Sealed this

Thirtieth Day of July, 1996

Bruce Lehman

*Attest:*

BRUCE LEHMAN

*Attesting Officer*

*Commissioner of Patents and Trademarks*